US006648072B1

(12) United States Patent
Blanchard

(10) Patent No.: US 6,648,072 B1
(45) Date of Patent: Nov. 18, 2003

(54) METHOD AND APPARATUS FOR DELIVERY OF TREATMENT CHEMICALS TO SUBTERRANEAN WELLS

(75) Inventor: Billy Blanchard, Baston, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/620,682

(22) Filed: Jul. 20, 2000

Related U.S. Application Data

(60) Provisional application No. 60/144,598, filed on Jul. 20, 1999.

(51) Int. Cl.[7] ..... E21B 37/00

(52) U.S. Cl. ..... 166/312; 166/90.1; 166/75.12

(58) Field of Search ..... 166/75.12, 90.1, 166/105, 310, 312

(56) References Cited

U.S. PATENT DOCUMENTS

| | | | | |
|---|---|---|---|---|
| 2,773,551 A | * | 12/1956 | Warden et al. | |
| 3,710,867 A | * | 1/1973 | Bansbach | |
| 4,064,936 A | * | 12/1977 | McClure | |
| 4,436,148 A | * | 3/1984 | Maxwell | 166/53 |
| 5,246,074 A | * | 9/1993 | Ayres | 166/310 |
| 5,343,941 A | * | 9/1994 | Raybon | 166/53 |

* cited by examiner

*Primary Examiner*—David Bagnell
*Assistant Examiner*—Jennifer R Dougherty

(57) ABSTRACT

A method and apparatus for delivering treatment chemicals to an oil and gas well. A flush pump siphons flush from the production line of a producing well and draws in a predetermined amount of treatment chemical into the siphoned flush and then discharges the combination into the well.

9 Claims, 5 Drawing Sheets

METHOD AND APPARATUS FOR DELIVERY OF TREATMENT CHEMICALS TO SUBTERRANEAN WELLS

RELATED APPLICATIONS

This application claims priority to Provisional Application Serial No. 60/144,598 filed Jul. 20, 1999 in the name of Billy Blanchard as inventor.

TECHNICAL FIELD OF THE INVENTION

The present invention relates to the chemical treatment of wells that are in a state of production. In one aspect, the present invention relates to use of a pump that mixes the desired treatment chemicals with sufficient volume of flush from the well to carry the chemicals to the downhole equipment.

BACKGROUND OF THE INVENTION

Producing wells commonly have pumps and other equipment inside and towards the bottom of the well. This equipment is subject to corrosion, and chemicals are used to protect this downhole equipment. One common method of treating downhole equipment is by using "treater trucks" that travel from well to well to deliver the chemicals. Valving at the well site is changed and the treater truck recycles flush from the well through the well while adding chemicals into this recycling flush. When the treater truck is finished, the valving is changed back to its production position. The use of treater trucks is expensive. Additionally, they are unreliable as weather, unreliability of the operator, equipment malfunctions, etc. may disrupt the planned schedule for well treatment. Also, treater trucks are heavy and can damage the land owner's roads and property. There is also a safety risk with the human treater truck operators handling valves at the well site which if not handled properly could damage equipment. Relying on treater trucks is also disadvantageous because there are no chemicals treating the well in between the treater truck visits.

Another method of treating wells is using a chemical pump that is permanently at the well site injecting chemicals into the well casing. While this pump can continuously provide the chemicals, the volume of chemicals is very low. Whereas the treater trucks mixed the chemicals with the large volume of recycling flush from the well, the stand alone chemical pumps are typically small positive displacement pumps that inject small quantities of chemicals that may just "float" near the top of the well without traveling to the bottom of the well in sufficient quantities to treat the downhole equipment.

U.S. Pat. No. 4,375,833 to Meadows discloses the use of valving that is electronically changed periodically to recycle the flush from the well as the treater truck method does. Upon change to the recycling position, chemicals are injected into the recycling flush. The drawbacks of this method is that once again the chemicals are only treating the well periodically. Additionally, during recycling, the production of the well is off line. The valving and controls for this system are expensive and require maintenance. The Meadows patents also discloses the use of a rod pump that is used to deliver chemicals into the well either like discussed above or in combination with the valving disclosed in the Meadows patent. For example, during recycling, the rod pump delivers chemicals into to recycling flush.

A need exists for a device and method for low cost, low maintenance delivery of chemicals that will effectively treat the well.

SUMMARY OF THE INVENTION

The present invention provides a method of introducing chemicals by a method for delivering treatment chemicals into a well by siphoning off a volume of flush from a production line of a well with a flush pump while the well remains in production and introducing treatment chemicals to the suction side of the flush pump to be combined with the flush. The combination of the treatment chemicals and flush is then discharged into the well by the flush pump. Another aspect of the present invention provides a flush pump for carrying out this method. Further aspects of the present invention combine the operation of a chemical pump on concert with the flush pump.

DETAILED DESCRIPTION OF THE PREFERRED EMBODIMENT

Figure 1:
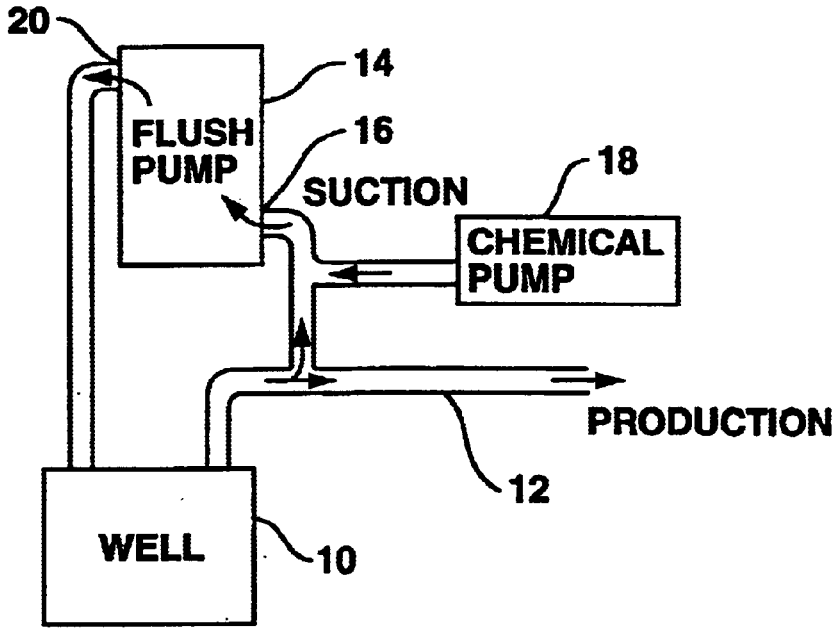
FIG. 1 is a schematic representation of the method of the present Invention.
Figure 2:
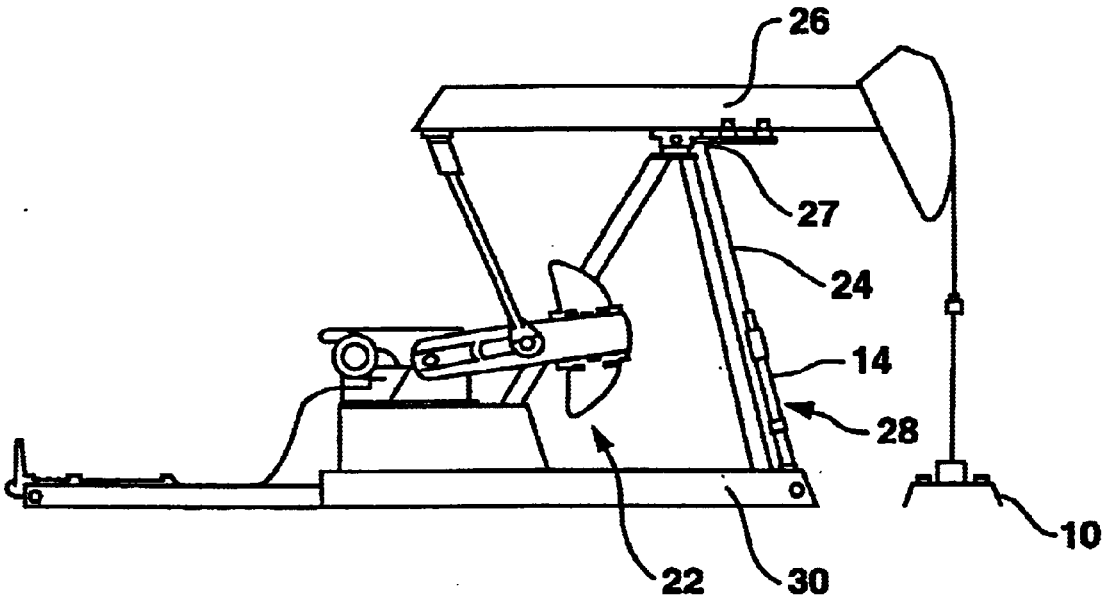
FIG. 2 is a side view of a pump jack with the pumping system of the present invention installed thereon.
Figure 3:
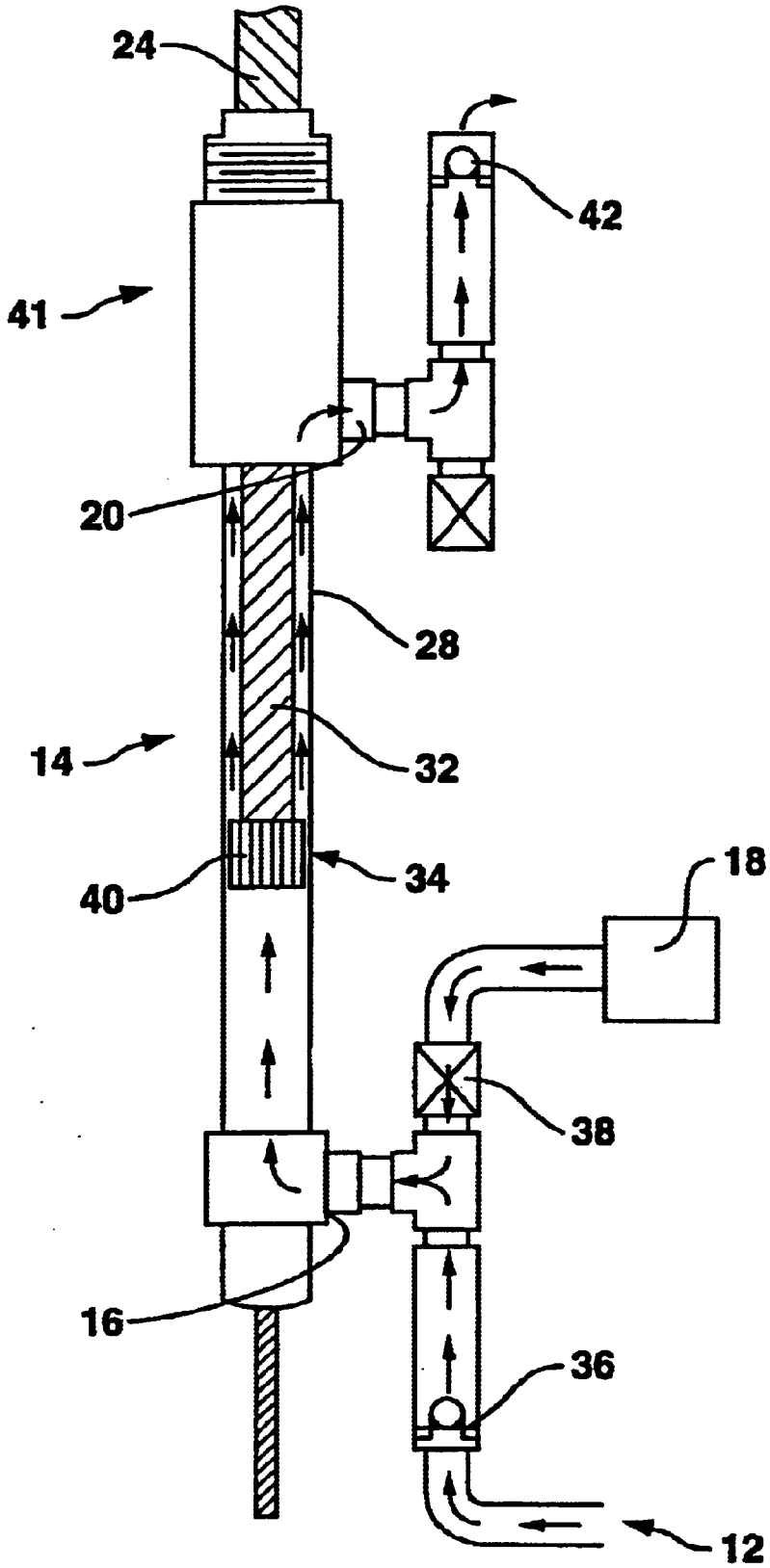
FIG. 3 is a side view and partial cross section of the pumping system of the present invention.

With reference to FIGS. 1–3, the preferred method and apparatus of the present invention will be described. FIG. 1 schematically represents the method of the present invention. Well 10 produces fluid (oil, gas, water, or mixture thereof) through production line 12. Flush pump 14 has suction end 16 in communication with production line 12 such that a portion of the production fluid, or flush, is siphoned off into pump 14. Chemical pump 18 injects treatment chemicals into suction end 16 to mix with the flush. The combination of the treatment chemicals and the flush are then discharged through discharge end 20 of pump 14 which is in communication with well 10. Due to the additional volume of the flush siphoned from production line 12, the treatment chemicals will be able to reach the bottom of well 10 to treat downhole equipment and formation.

FIG. 2 shows flush pump 14 installed on pump jack 22. Flush pump 14 is preferably a type of rod pump which is known in the art. Flush pump 14 has rod 24 that is attached to walking beam 26 of pump jack 22 at top mount 27. As walking beam 26 travels, the other end of rod 24 is reciprocated within pump housing 28 which is mounted to base 30 of pump jack 22. With reference to FIG. 3, rod 24 terminates inside housing 28 with plunger 32 with mixing head 34. As plunger 32 reciprocates, flush from production line 12 is drawn through inlet ball valve 36 and into suction end 16. Also treatment chemicals from chemical pump 18 are drawn through valve 38 into suction end 16. The amount of treatment chemicals drawn per stroke is preferably controlled by controlling the discharge of the chemical pump. The amount of flush drawn per stroke is a function of the internal volume of flush pump 14. By sizing the flush pump and controlling the chemical pump, the desired amount of chemicals per volume of flush can be achieved. Flush and treatment chemicals are drawn into flush pump 14 on the upstroke of plunger 32. On the downstroke, mixing head 34 mixes the chemicals with the flush by virtue of the two fluids being forced through grooves 40 on the outer surface of mixing head 34. Inlet ball valve 36 prevents any back flow of flush into production line 12 and valve 38 prevents back flow of chemicals into chemical pump 18. On the downstroke, plunger 32 displaces the treatment chemicals and flush through outlet ball valve 42 at discharge end 20 of flush pump 14. As can be seen, flush pump 14 is driven by the walking beam of the pump jack so pump 14 continuously delivers treatment chemicals with a sufficient volume of flush to carry the treatment chemicals downhole. Rod 24 also reciprocates through packing box 41 which helps seal against fluid leaking out of housing 28 around rod 24.

Figure 4:
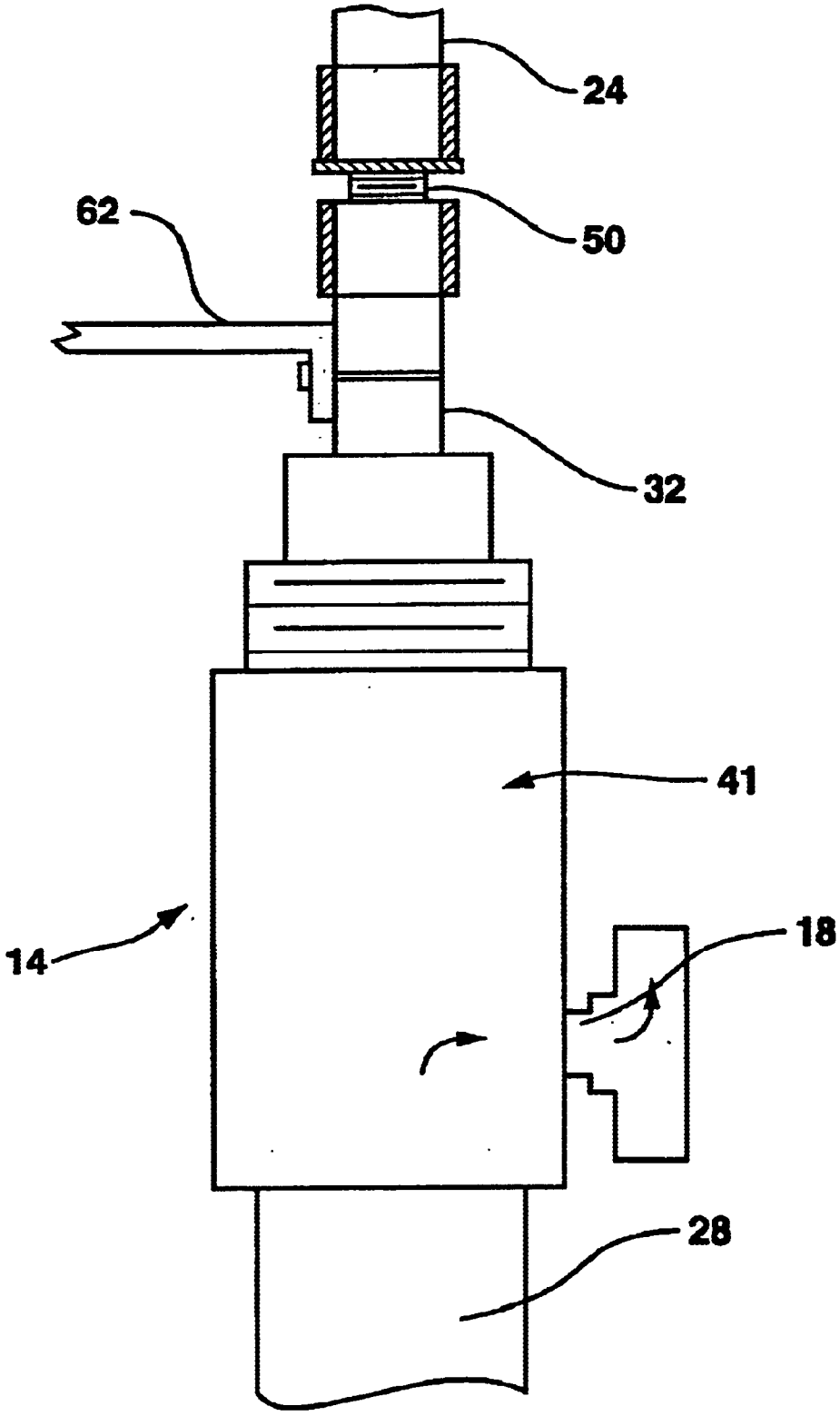
FIG. 4 is a side view of the top of the pumping system of the present invention.

With reference to FIG. 4, a safety feature of the present invention is shown. Break away sub 50 is connected in line between rod 24 and plunger 32. Should the pressure inside housing 28 exceed a set maximum, break away sub 50 is designed to break before the excessive pressure damages flush pump 14 or interferes with pump jack 22.

Figure 5:
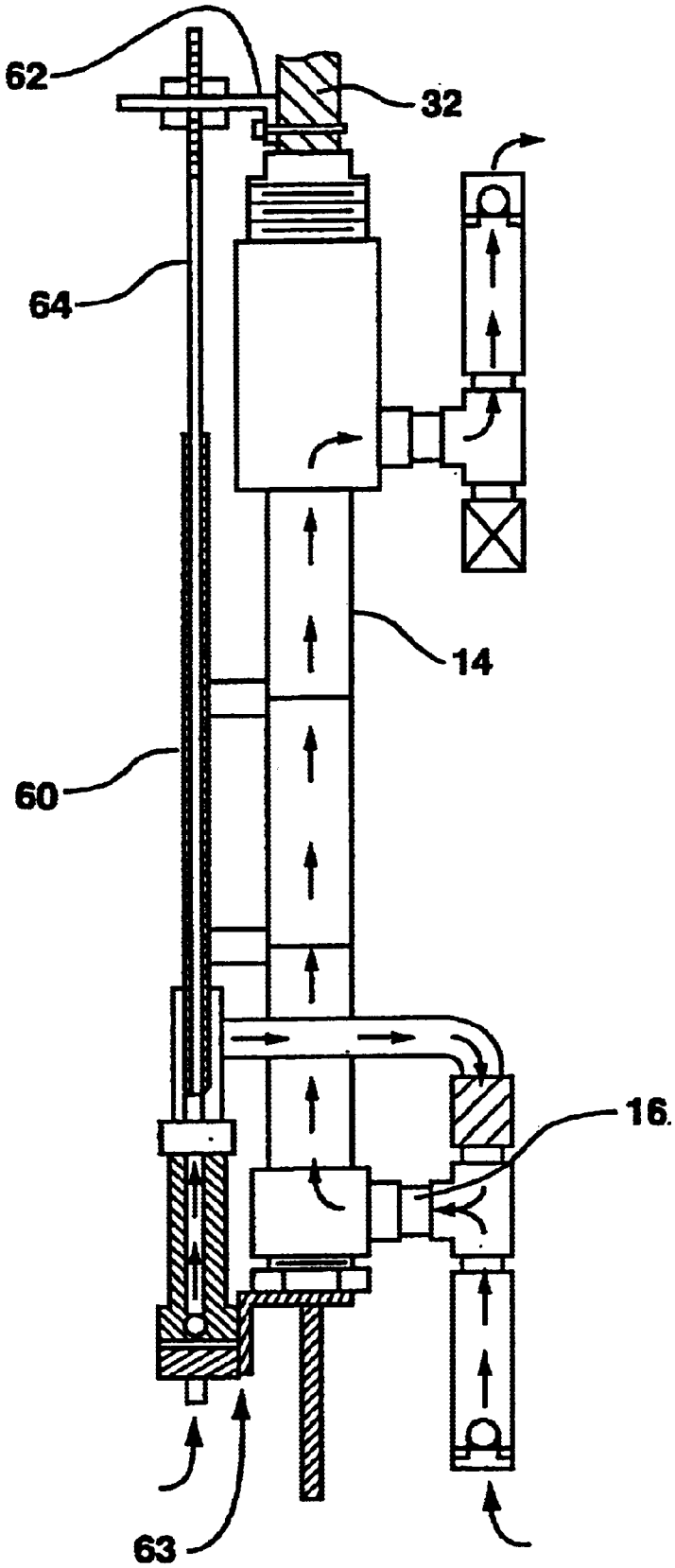
FIG. 5 is a side view of an alternative embodiment of the present invention with a tandem chemical pump and flush pump.

With reference to FIG. 5, an alternative embodiment of the present invention is shown where chemical pump 60 is a rod pump for delivery of treatment chemicals into suction end 16 of flush pump 14. Chemical pump 60 is mounted in tandem with flush pump 14 by rod mount 62 and bracket 63 which couples rod 64 of chemical pump 60 to plunger 32 of flush pump 14 in a spaced apart parallel relationship. As such, rod 64 reciprocates together with plunger 32. In this way, walking beam 26 is used to power both the flush pump and the chemical pump.

Figure 6:
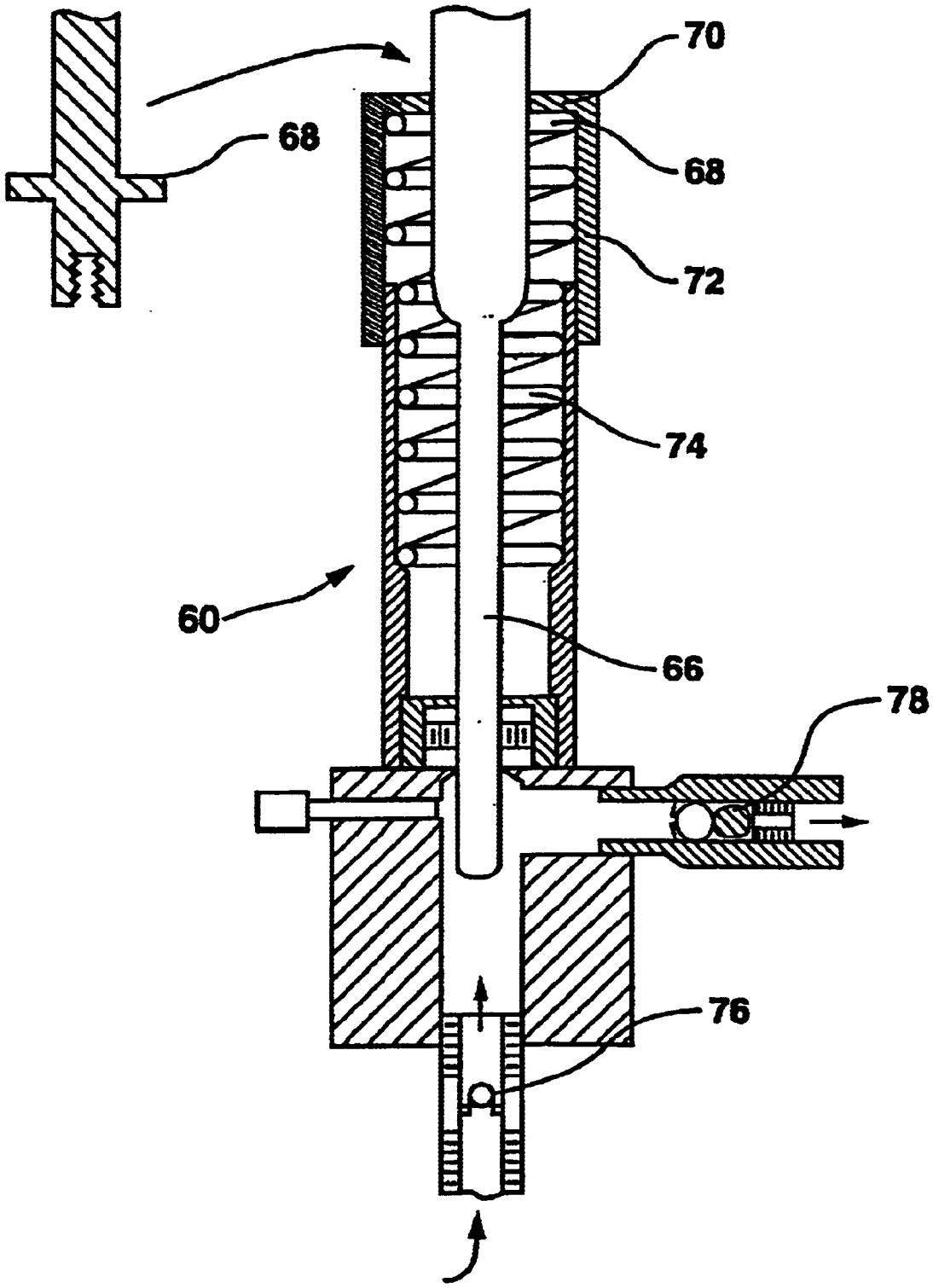
FIG. 6 is a cross-section view of the tandem chemical pump of FIG. 5.

With reference to FIG. 6, a more detailed view of chemical pump 60 is shown. Plunger 66 has flange 68 which is biased against shoulder 70 of housing 72 by spring 74. On the up stroke, chemical is drawn through inlet ball valve 76 and on the down stroke the chemicals are discharged through outlet ball valve 78. This coordinates with flush pump 14.

It can be appreciated that treatment chemicals can be delivered to suction end 16 of flush pump 14 without a chemical pump, for example, a metering device place between suction end 16 and a source for the treatment chemicals. Regardless of how the chemicals are introduced into flush pump 14, they are mixed with a significant volume of flush without interrupting the production of well 10 and then discharged into the well. The volume of flush is sufficient to carry the treatment chemicals down the well.

What is claimed is:

1. A method for delivering treatment chemicals into a well, comprising the steps of:

siphoning off a volume of flush from a production line of a well with a flush pump while the well remains in production;

introducing treatment chemicals to a suction side of the flush pump to be combined with the flush; and discharging the combination of the treatment chemicals and flush into the well; wherein the flush pump comprises a rod that is reciprocatable within a housing, and wherein the rod has a plunger end located within the housing and as the plunger is moved in a first direction, flush is drawn into the housing through a first valve and as the plunger is moved in a second direction opposite from the first direction, the flush is ejected through a second valve.

2. The method of claim 1 wherein as the plunger moved in the first direction, a chemical for treatment of the well is also drawn into the housing through the first valve.

3. The method of claim 2 wherein the plunger is adapted to mix the chemical and flush within the housing as the plunger moves within the housing.

4. The method of claim 2 wherein chemical is drawn from the output of a chemical pump that metes a predetermined amount of chemical.

5. The method of claim 4 wherein the chemical pump comprises a second rod that is reciprocatable within a second housing.

6. The method of claim 5 wherein as the second rod is moved in a first direction, the chemical is drawn into the second housing through a third valve and as the second rod is moved in a second direction opposite from the first direction, the chemical is ejected through a fourth valve to be drawn into the flush pump.

7. The method of claim 6 wherein the chemical pump is mounted generally parallel with the flush pump such that both the rod and the second rod are reciprocated by a walking beam.

8. The method of claim 1 wherein the rod is connected to a break away sub outside the housing that will break upon reaching a predetermined pressure within the housing.

9. The method of claim 1 wherein the flush pump is powered by a walking beam of a pump jack.

* * * * *